US008511248B2

(12) United States Patent
Mora et al.

(10) Patent No.: US 8,511,248 B2
(45) **Date of Patent: *Aug. 20, 2013**

(54) LIFEBOAT SUSPENSION SYSTEMS

(75) Inventors: Anthony Mora, Julian, CA (US); Sidney Medley, Menifee, CA (US); Russell Tuckerman, Rio Linda, CA (US); Roger Lopez, El Cajon, CA (US)

(73) Assignee: Survival Systems International, Inc., Valley Center, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/491,272

(22) Filed: Jun. 7, 2012

(65) Prior Publication Data

US 2012/0247382 A1 Oct. 4, 2012

Related U.S. Application Data

(63) Continuation of application No. 12/443,166, filed on Dec. 23, 2009, now Pat. No. 8,215,257.

(51) Int. Cl.
*B63B 23/00* (2006.01)

(52) U.S. Cl.
USPC ..... 114/378; 294/82.27

(58) Field of Classification Search
USPC ..... 114/365, 377, 378, 380; 294/82.27, 294/82.17, 82.24
See application file for complete search history.

(56) References Cited

U.S. PATENT DOCUMENTS

| | | | |
|---|---|---|---|
| 4,106,144 | A | 8/1978 | Chabot |
| 4,348,043 | A | 9/1982 | Fandel |
| 4,461,233 | A | 7/1984 | Nilsson |
| 4,822,311 | A | 4/1989 | Doerffer et al. |
| D310,058 | S | 8/1990 | Thompson et al. |
| 7,360,498 | B1 | 4/2008 | Mora et al. |
| 7,412,941 | B2 | 8/2008 | Mora et al. |
| 7,832,350 | B2 | 11/2010 | Mora et al. |

FOREIGN PATENT DOCUMENTS

| | | |
|---|---|---|
| DE | 880490 | 2/1988 |
| EP | 0064045 | 4/1982 |
| GB | 568215 | 3/1945 |

*Primary Examiner* — Stephen Avila
*Assistant Examiner* — Anthony Wiest
(74) *Attorney, Agent, or Firm* — Sheppard Mullin Richter & Hampton LLP

(57) ABSTRACT

A suspension system for a lifeboat comprises a pair of hook assemblies each adapted for connection at spaced locations to a lifeboat and for coupling to the lifting links of a pair of suspension cables. Each hook assembly has a hook member pivoted for movement between a closed setting and an open setting and is of a load over center design. A single control mechanism is provided for both hook assemblies and is connected thereto by way of a pair of flexible cables. A primary release mechanism is arranged to pull the cables and so move the hook members to their open settings when the lifeboat is floating. Under emergency conditions when the hook assemblies are heavily loaded, an emergency release mechanism is arranged to move the hook members to their open settings notwithstanding the relatively large load thereon.

18 Claims, 9 Drawing Sheets

LIFEBOAT SUSPENSION SYSTEMS

CROSS-REFERENCE TO RELATED APPLICATIONS

This application is a continuation of U.S. patent application Ser. No. 12/443,166, filed Dec. 23, 2009, now U.S. Pat. No. 8,215,257, which claims priority to PCT Application Number PCT/GB2007/50597, filed Oct. 1, 2007, the contents of which are incorporated herein by reference in their entireties.

TECHNICAL FIELD

This invention relates to a suspension system for a lifeboat. In particular, the invention relates to a suspension system having a pair of hook assemblies adapted for connection at spaced locations to a lifeboat and a control mechanism for those hook assemblies.

DESCRIPTION OF THE RELATED ART

A ship, oil rig or other sea structure (all of which are for convenience referred to hereinafter simply as a "ship") is usually provided with one or more lifeboats to allow emergency evacuation. Often, such lifeboats are suspended on a pair of cables hanging from davits provided on the ship, a pair of releasable hook assemblies being mounted on the lifeboat for lifting links provided on the lower ends of the cables. The hook assemblies may be opened when the lifeboat is floating and is to be released from the ship. Generally, it is important that the hook assemblies cannot be released from the suspension cables until the lifeboat is floating; at this time the hook assemblies are not subjected to any significant load. Occasionally however, emergency operation is required before the lifeboat is floating, and so when the hook assemblies are carrying the full weight of the lifeboat and contained personnel.

International regulations require a releasable hook assembly for a ship's lifeboat to be capable of opening when carrying 110% of the normal maximum laden weight of the lifeboat, in order to accommodate such emergency operation. The hook assembly must therefore be designed to allow operation under maximum loading and yet to resist accidental opening other than when the hook assemblies are lightly (or not at all) loaded, as when the lifeboat is floating.

A design of hook assembly in wide use is arranged so that the load on a pivoted hook member of that assembly imparts a couple on the hook member in the sense which opens the hook, so as to be released from a lifting link at the lower end of a suspension cable. A lock mechanism is provided for the hook member to prevent the pivoting thereof, but when released, the hook member immediately pivots round under the load on the hook member to release the lifting link. Such a hook assembly is described in greater detail hereinafter, with reference to FIG. 1.

Unfortunately, experience has shown that hook assemblies as described above occasionally open unintentionally or even are opened inadvertently when under full load, in view of the couple on the hook member imparted by the load itself. Such unintended and so unexpected release, typically of only one end of a suspended lifeboat, is likely to lead to serious accidents and often fatalities of personnel in the lifeboat. This has become a serious problem for seafarers and discourages the performance of lifeboat drills, in view of the risk of accidents.

An attempt at solving the problem of inadvertent or unexpected opening of a hook assembly where the load of the lifeboat imparts an opening couple on the hook member is to employ a hydrostatic interlock valve, commonly referred to in the art as a hydrostat. The hydrostat includes a diaphragm located in the hull of a lifeboat and which is activated when the boat reaches the water; the hydrostat then releases a locking mechanism for the hook member, which otherwise holds the hook member in its closed setting. Poorly maintained and performing hydrostats are common and so are less than totally reliable. Moreover, under emergency conditions when the hook member is to be opened under load, the operation of the hydrostat locking mechanism must be overridden.

An alternative approach to this problem of inadvertent opening is to employ a so-called load over centre hook assembly where the line of action of a load imparted to a hook member by a lifting link passes through the centre of the pivotal axis of the hook member. By appropriate design, the opening couple on the hook member may be eliminated but experience has shown that then very high forces have to be imported on the hook member when the hook assembly is to be opened under 110% of the maximum laden weight of the lifeboat. If a suitable mechanism is provided for imparting that high force, then the mechanism is inconvenient to operate under no load conditions (when the lifeboat is floating) and moreover this mechanism does not address the problem of accidental or inadvertent operation thereof, before the lifeboat is floating.

BRIEF SUMMARY OF EMBODIMENTS THE INVENTION

It is a principal aim of the present invention to provide a suspension system for a lifeboat which at least mitigates if not wholly overcomes the problems associated with the known designs of suspension systems incorporating hook assemblies which may be opened to release a lifeboat, either under no-load conditions or under 110% loading of the maximum laden weight of the lifeboat.

According to this invention, there is provided a suspension system for a lifeboat comprising, in combination: a pair of hook assemblies adapted for connection at spaced locations to a lifeboat and for coupling respectively to a pair of suspension cables, each said hook assembly having a hook member pivoted for movement about a pivotal axis between a closed setting where the line of action of a load on the hook member when in use passes substantially through the pivotal axis thereof and an open setting where an associated suspension cable is released from the hook member; and a control mechanism for said pair of hook assemblies which control mechanism comprises a housing, a control member mounted for movement within the housing, a pair of flexible release cables each having one end operatively connected to the control member and another end connected to a respective hook member to effect pivoting movement thereof, a primary release mechanism for use when the hook assemblies are under no substantial load, the primary release mechanism being coupled to the control member and having a release handle arranged so that when operated from a normal position to a hook-open position the control member is moved thereby pulling the flexible cables to pivot the hook members to their open settings, and an emergency release mechanism also connected to the control member to effect movement thereof to move the hook members to their open settings, the emergency release mechanism being for use when the hook assemblies are under significant load and having a high mechanical advantage relative to that of the primary release mechanism.

It will be appreciated that with the suspension system of this invention, a pair of so-called load over centre hook assemblies are employed, where the line of action of a load on the hook member passes substantially through the pivotal axis of the hook member. As a consequence, no significant rotational couple is imparted to the hook member irrespective of the loading on the hook member. When the hook assembly is not loaded, or is only lightly loaded, the primary release mechanism may be employed to move the hook member of each assembly to its open setting. When the hook assemblies are significantly loaded, up to perhaps 110% of the normal maximum laden weight, the primary release mechanism is incapable of opening the hook assemblies. Those hook assemblies may still be opened but only by using the emergency release mechanism which has a high mechanical advantage compared to that of the primary release mechanism, and typically several times, and perhaps a few tens of times, of that of the primary release mechanism.

Since the hook assemblies cannot be opened with the primary release mechanism, inadvertent or accidental opening of the hook assemblies when the assemblies are still loaded is eliminated. However, the hook assemblies can still be opened when required under emergency conditions, by employing the separate emergency release mechanism.

Preferably, each hook assembly has a side plate, though a preferred embodiment has a pair of spaced side plates, provided with means for attachment directly or indirectly to a lifeboat. The hook member is pivotally mounted between the side plates and has a throat defined by an arcuate surface for engagement by a suspension cable or a lifting link provided at the free end of the cable. The arcuate surface is substantially centred on the pivotal axis of the hook member and the hook member, pivotal axis and the attachment means are arranged such that the line of action of a load applied to the hook assembly by an attached lifeboat and by a suspension cable retained by the hook member when in its closed setting passes substantially through the pivotal axis of the hook member.

Each hook assembly may have a retainer pivotally mounted to the side plates for movement between first and second positions. Mien the retainer is in its first position, it serves to close the throat of the hook member when in its closed setting, to prevent a suspension cable or lifting link coupled to the hook member coming free thereof. When the hook member is in its closed setting, the retainer may be pivoted to its second position in order to allow a suspension cable or lifting link to be coupled to the hook member. Conveniently, the retainer is furnished with a counterweight to urge the retainer to its first position.

The control member may be provided with means to bias that member to a normal position where the hook members are in their closed settings. Though a spring, gas cylinder or other means could be provided for this purpose, the preferred embodiment employs a mass slidably mounted within the housing of the control mechanism and which is urged under gravity to a lower position where the hook members are in their closed settings. For this purpose, each of the flexible release cables must be capable of transferring a relatively small compressive force, as well as the relatively high tensile forces required for opening the hook assemblies when under load. With this embodiment, both the primary and emergency release mechanisms may be arranged to lift the mass against gravity and so also to pull the hook members, through the control member and the flexible cables, to their open settings.

The primary release mechanism may include a pivoted release handle movable through about 90°, to effect opening of the hook assemblies. That mechanism may include a release arm forming an over centre mechanism with a guide extending transversely of the line of movement of the control member, such that when operated to the hook-open position, the over centre mechanism maintains the primary release mechanism in that position.

The emergency release mechanism may include a toothed rack associated with the control member and engaged by a pinion mounted on a shaft projecting from the housing of the control mechanism. When required for use, an emergency release lever may be engaged with the projecting part of the shaft, in order to effect rotation of the pinion to drive the toothed rack and so move the control member to the hook open position. In order to allow sufficient force to be imparted to the rack, a relatively long emergency release lever may be provided. Further, a ratchet mechanism may be associated with the emergency release mechanism in order to allow multiple reciprocations of the emergency release lever.

BRIEF DESCRIPTION OF THE. DRAWINGS

By way of example only, one specific embodiment of lifeboat suspension system of this invention will now be described in detail, reference being made to the accompanying drawings in which.

DETAILED DESCRIPTION OF THE EMBODIMENTS OF THE INVENTION

Figure 1:
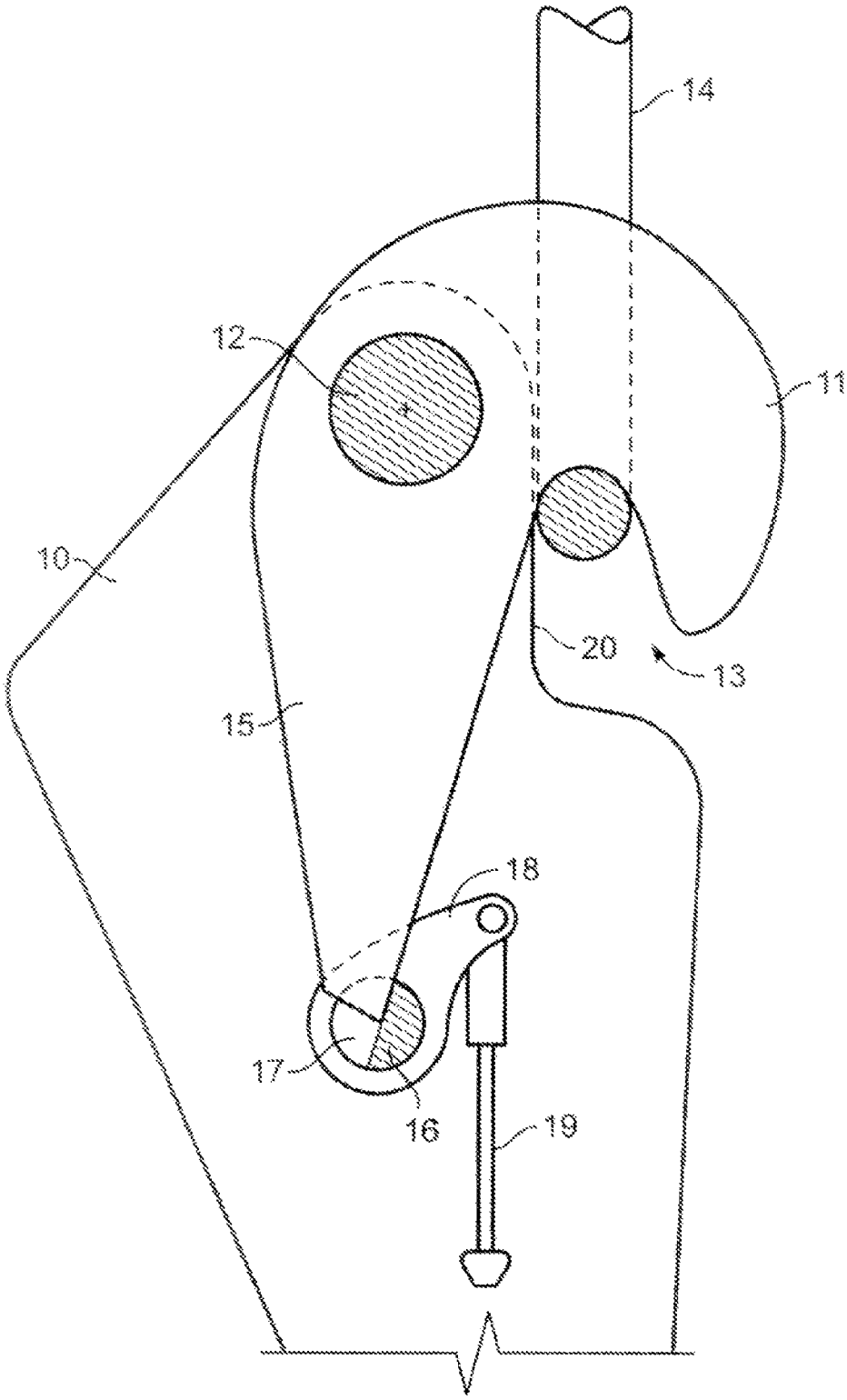
FIG. 1 (Prior Art)
FIG. 1 illustrates a prior art hook assembly, as has been described hereinbefore.

FIG. 1 shows a prior art hook assembly for use in suspending a lifeboat from a ship, oil rig or the like, for lowering the lifeboat into the sea in an emergency situation. Similar hook assemblies are currently widely used in the industry, to allow a lifeboat to be lowered to the sea and then released from the suspension cables. The hook assembly has a body formed from two side plates 10 with a hook member 11 pivoted about a shaft 12 extending between the two side plates 10. The hook member defines a throat 13 in which is located a lifting link 14 secured to the free end of a suspension cable (not shown) typically hanging from a davit provided on a ship. The hook member has a tail 15 the free end of which engages a locking cam 16 also rotatably supported between the side plates on a further shaft 17, the cam being provided with a cam crank 18 to which is connected an operating cable 19.

As will be appreciated, the lifting link 14 is retained by the hook member 11 when in its closed position as shown in FIG. 1, with that link bearing against edges 20 of the two side plates. As the line of action of the link 14 is displaced laterally from the shaft 12, a rotational couple in the counterclockwise sense (in FIG. 1) is imparted to the hook member by the load of the lifeboat, tending to open the hook but resisted by the cam 16. When the lifeboat is to be released, the cable 19 is pulled so freeing the tail 15 of the hook member from the cam 16. The hook member rotates in the counterclockwise direction by virtue of the couple on the hook member, so freeing the lifting link 14 from the hook assembly.

The greater the load on the hook assembly, the more readily will the hook member 11 rotate in the counter-clockwise sense once freed by the cam 16, such that opening of the hook assembly to release a lifeboat connected thereto can be assured notwithstanding the load imparted on the hook assembly by the lifeboat. On the other hand, it is relatively easy for the hook member to be freed to rotate about shaft 12 even when not required to do so, thus leading to premature release of the lifeboat and possible injury to personnel in the lifeboat.

Figure 2:
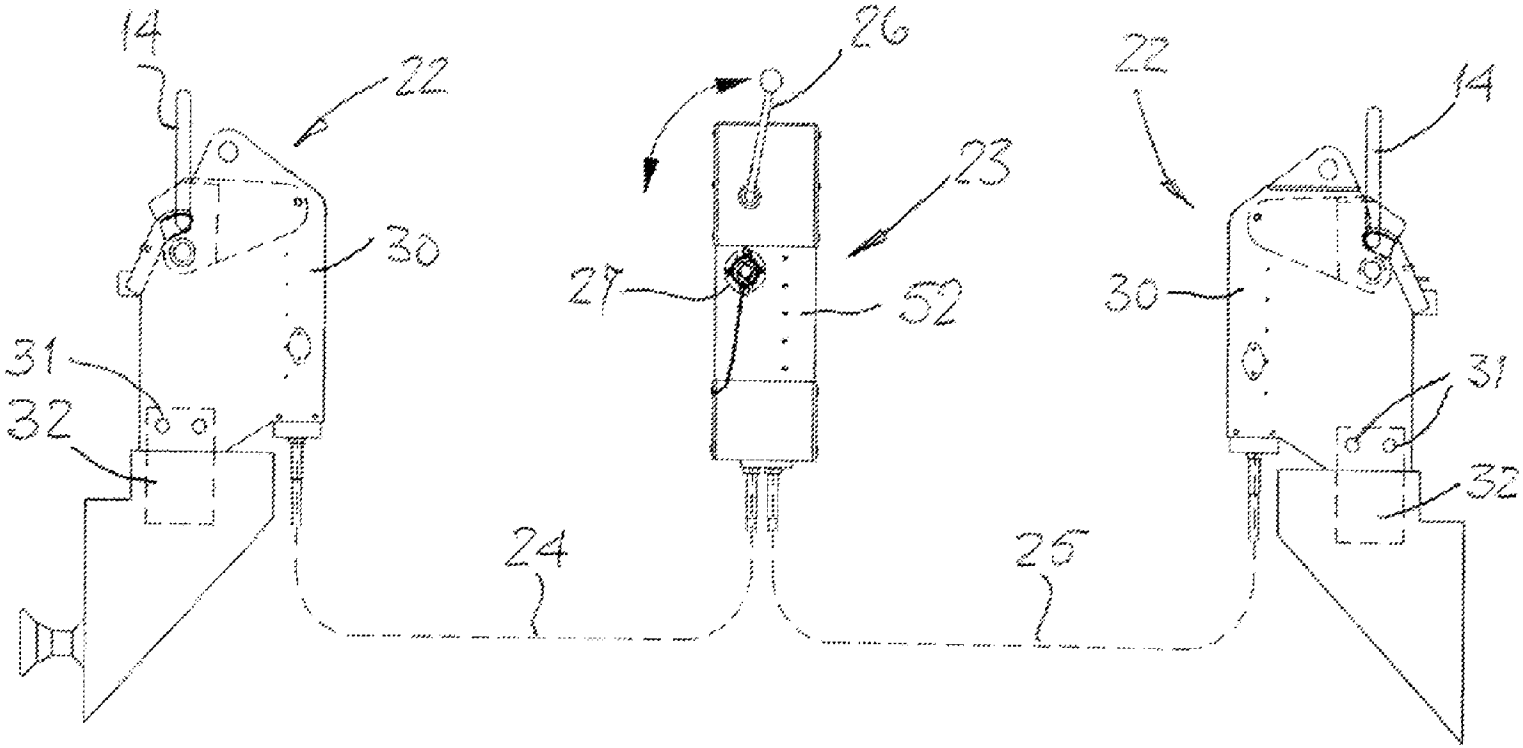
FIG. 2 shows the embodiment of lifeboat suspension system of this invention, in its setting where a lifeboat (not shown) is suspended from a pair of suspension cables (also not shown)

Referring now to FIGS. 2 to 9, a suspension system of this invention will be described, which does not suffer the disadvantage of the prior art hook assembly described above. FIG. 2 shows a pair of hook assemblies 22 in their closed settings with a respective lifting link 14 engaged therewith. Also shown is a control mechanism 23 linked to the two hook assemblies by way of a pair of flexible cables 24,25 each able to impart significant tensile loads and relatively small compressive loads from the control mechanism 23 to the two hook assemblies 22.

The control mechanism 23 has a primary release handle 26 shown in FIG. 2 in its normal position but which may be pivoted in the counter-clockwise sense (in FIG. 2) to pull on both flexible cables 24,25 and so release the respective lifting link 14 from each of the two hook assemblies 22. This release handle 26 is intended for normal operation when there is no substantial load on the hook assemblies, in order to effect release of the lifting links for example when the lifeboat has been lowered and is floating. Insufficient force can be applied by the release handle 26 to the flexible cables 24,25 in an emergency situation, to release the lifeboat when still suspended and heavily loaded. To allow this to be achieved, there is provided within the control mechanism an emergency release mechanism having an external shaft 27 engageable by an emergency release lever 28, shown in FIG. 9.

Figure 3:
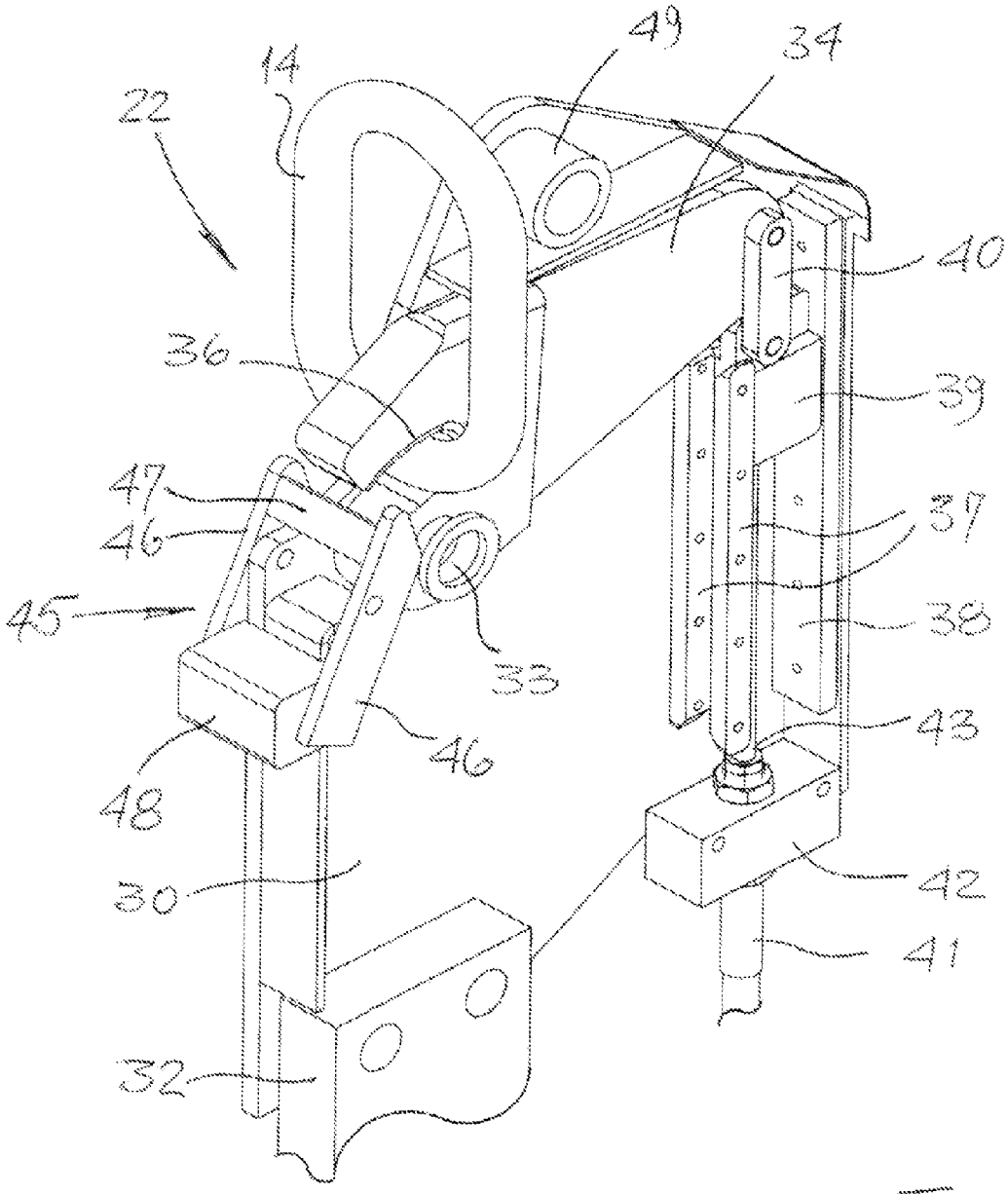
FIG. 3 is an isometric view of one of the hook assemblies of the system of FIG. 2, with one side plate removed for clarity.
Figure 4:
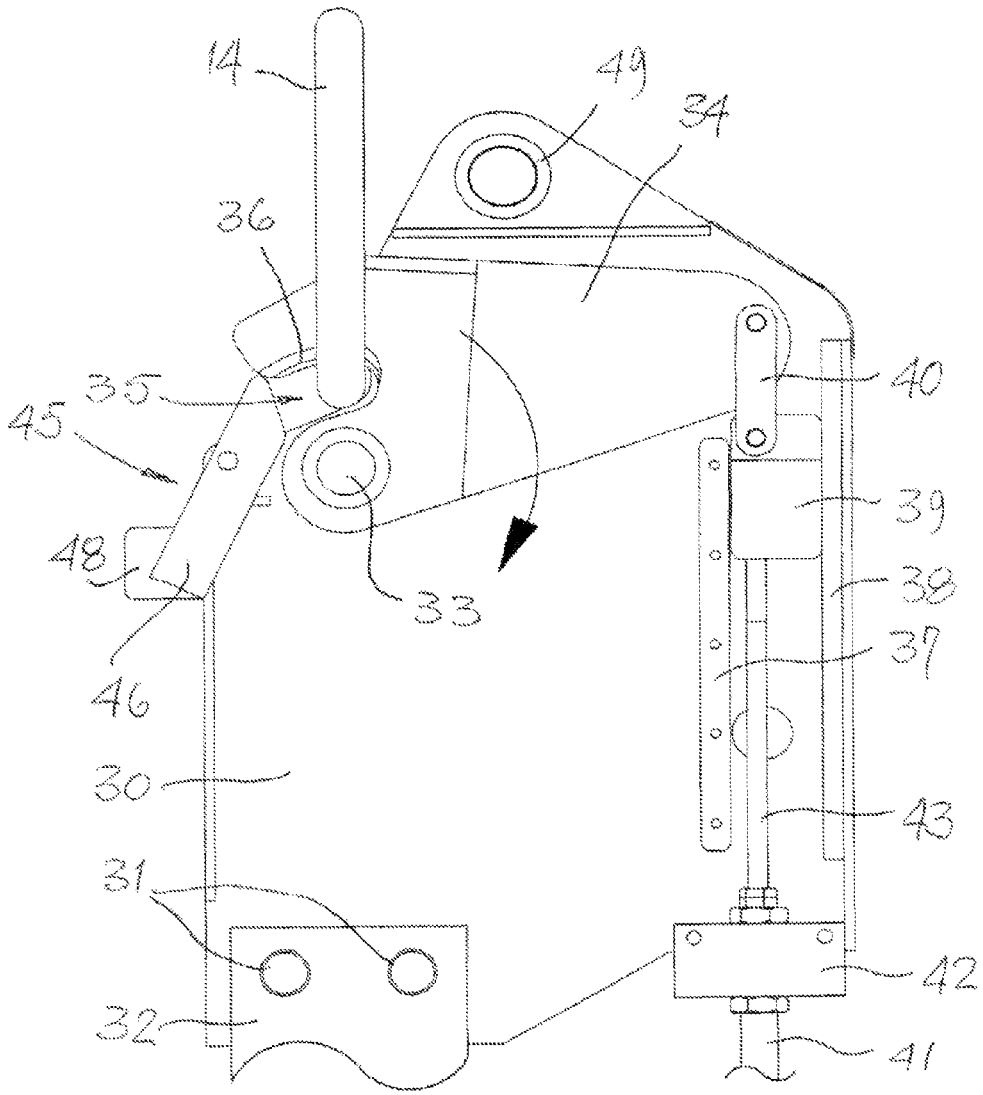
FIGS. 4 and 5 are side views of a hook assembly, respectively in closed and open settings with one side plate removed.
Figure 5:
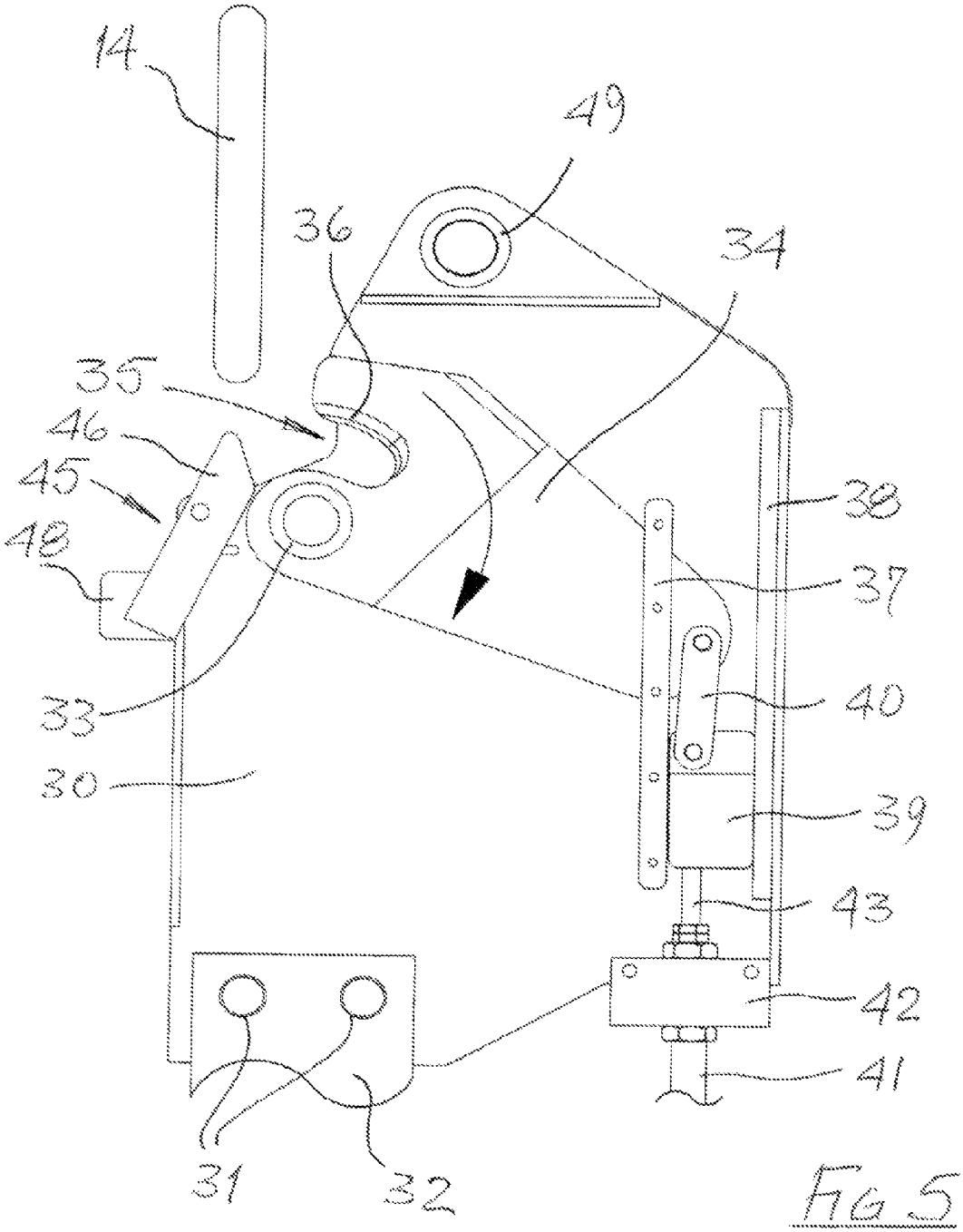

The details of each hook assembly 22 are shown in FIGS. 3,4 and 5. Each hook assembly comprises a pair of side plates 30 provided at their lower regions with a pair of transverse holes 31 by means of which the hook assembly may be bolted to a lifeboat mount 32, formed as a part of a lifeboat. Rotationally mounted between the side plates on a shaft 33 is a hook member 34 having a throat 35. The upper edge 36 of that throat 35 is of arcuate form, centered on the pivotal axis of the shaft 33. The holes 31, hollow shaft 33 and upper edge 36 of the throat 35 are arranged such that when in use, a load imparted to the hook assembly by a lifting link 14 passes through the axis of rotation of the hook member, about shaft 33. It will thus be appreciated that the load imparts no rotational couple on the hook member, irrespective of the magnitude of that load. Such a hook assembly is referred to herein as a "load over centre" assembly.

Also mounted between the side plates 30 is a pair of guides 37 and on the adjacent edge wall a further guide 38. A block 39 is slidably mounted between those guides and is connected to the hook member 34 by means of a pivoted link 40. The flexible cable 24 has an outer sheath 41 secured in a cable block 42 also mounted between the two side plates 30, and an inner cable 43 the free end of which is secured to the block 39. Pulling of the inner cable 43 by the control mechanism thus slides the block 39 from the position shown in FIG. 4, where the hook member is in its closed setting, to the position shown in FIG. 5, so rotating the hook member to its open setting and thus releasing the lifting link 14.

Also pivoted between side plates 30 is a retainer 45 comprising a pair of arms 46 together with a cross bar 47 adjacent one end of those arms and a counterweight 48 at the other end. The retainer is shown in its normal position in FIGS. 3 and 4, where the one ends and cross bar 47 serve to prevent a lifting link 14 coming free of the hook member 34, unless the retainer is pivoted from that shown position. The retainer may be pivoted in a clockwise sense, when the hook member is in its closed setting (FIG. 4) against the bias provided by the counterweight, when a lifting link is to be engaged with the hook member 34.

Also extending between the side plates 30 in the upper region thereof is a lifting eye 49, for use for example when maintenance of a lifeboat or a part of the suspension system is required and the normal control mechanism is not to be used.

Figure 6:
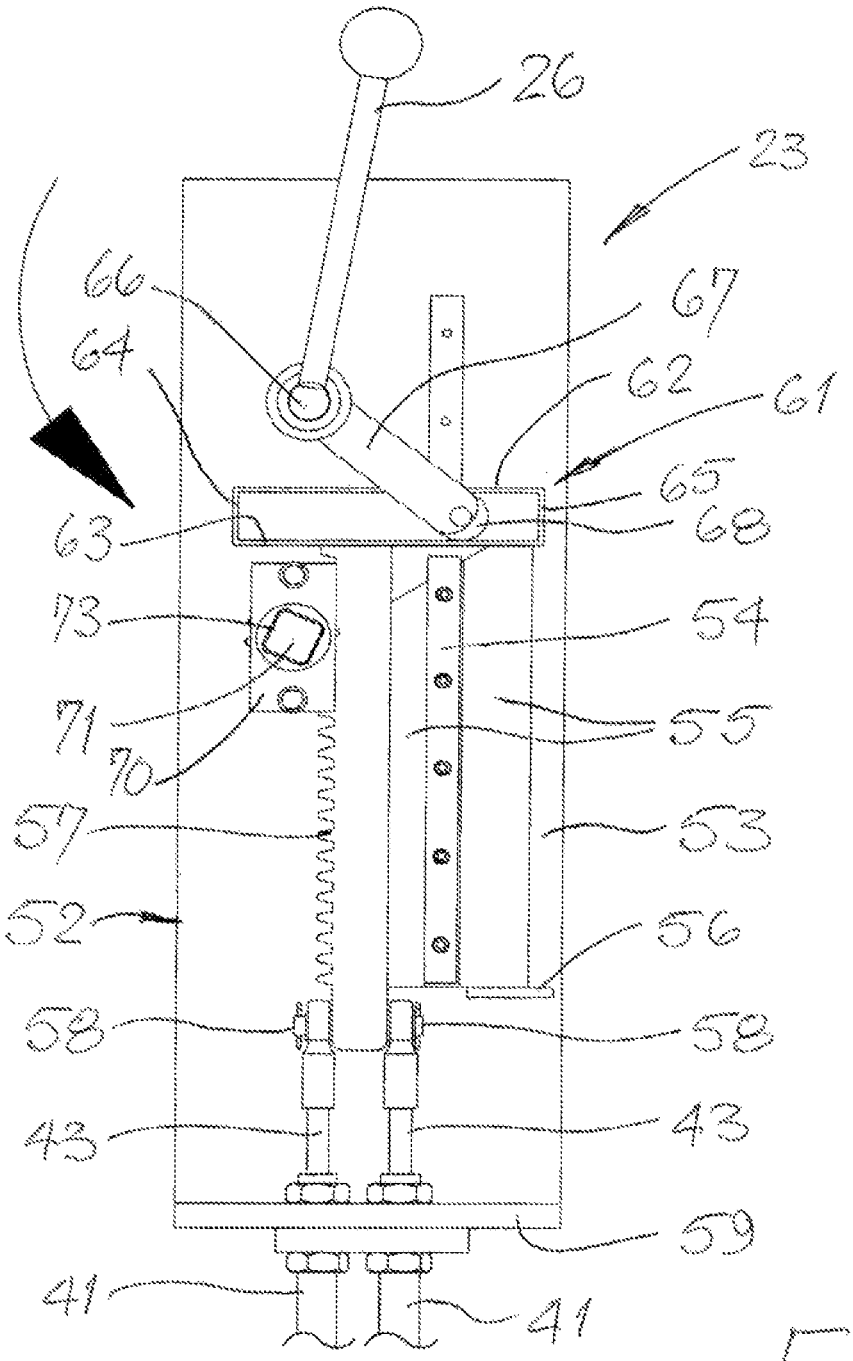
FIGS. 6 and 7 are cut away views of the control mechanism shown in FIG. 2, respectively in normal and hook-open positions.
Figure 7:
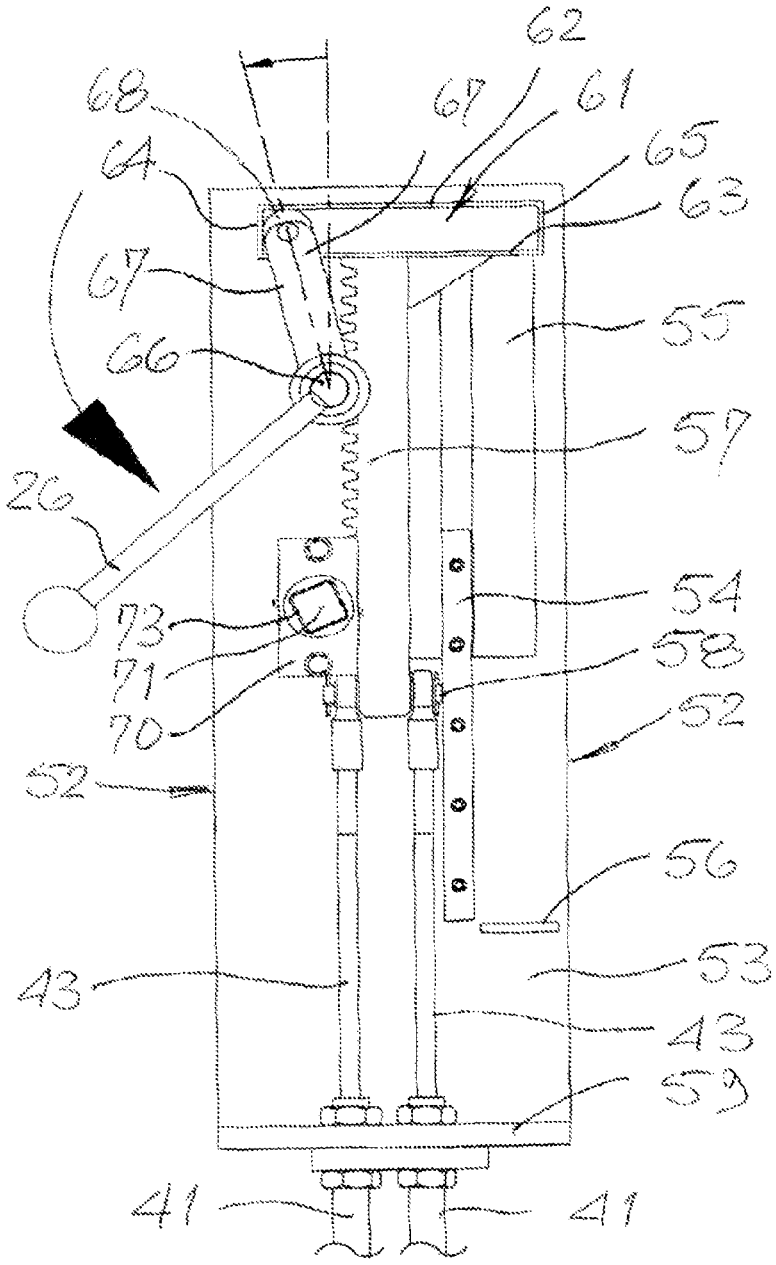
Figure 8:
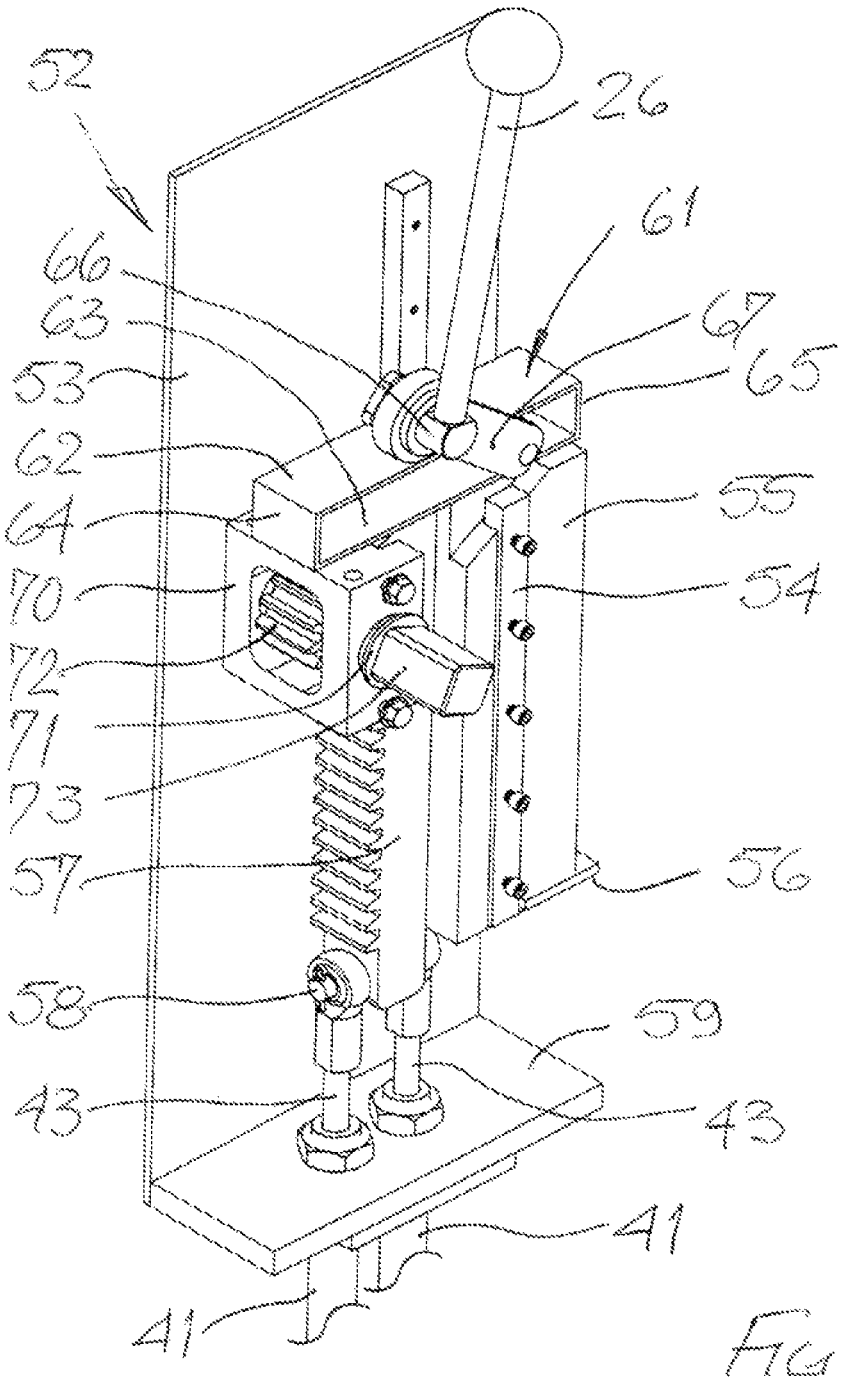
FIG. 8 is a cut away isometric view of the mechanism of FIGS. 6 and 7.
Figure 9:
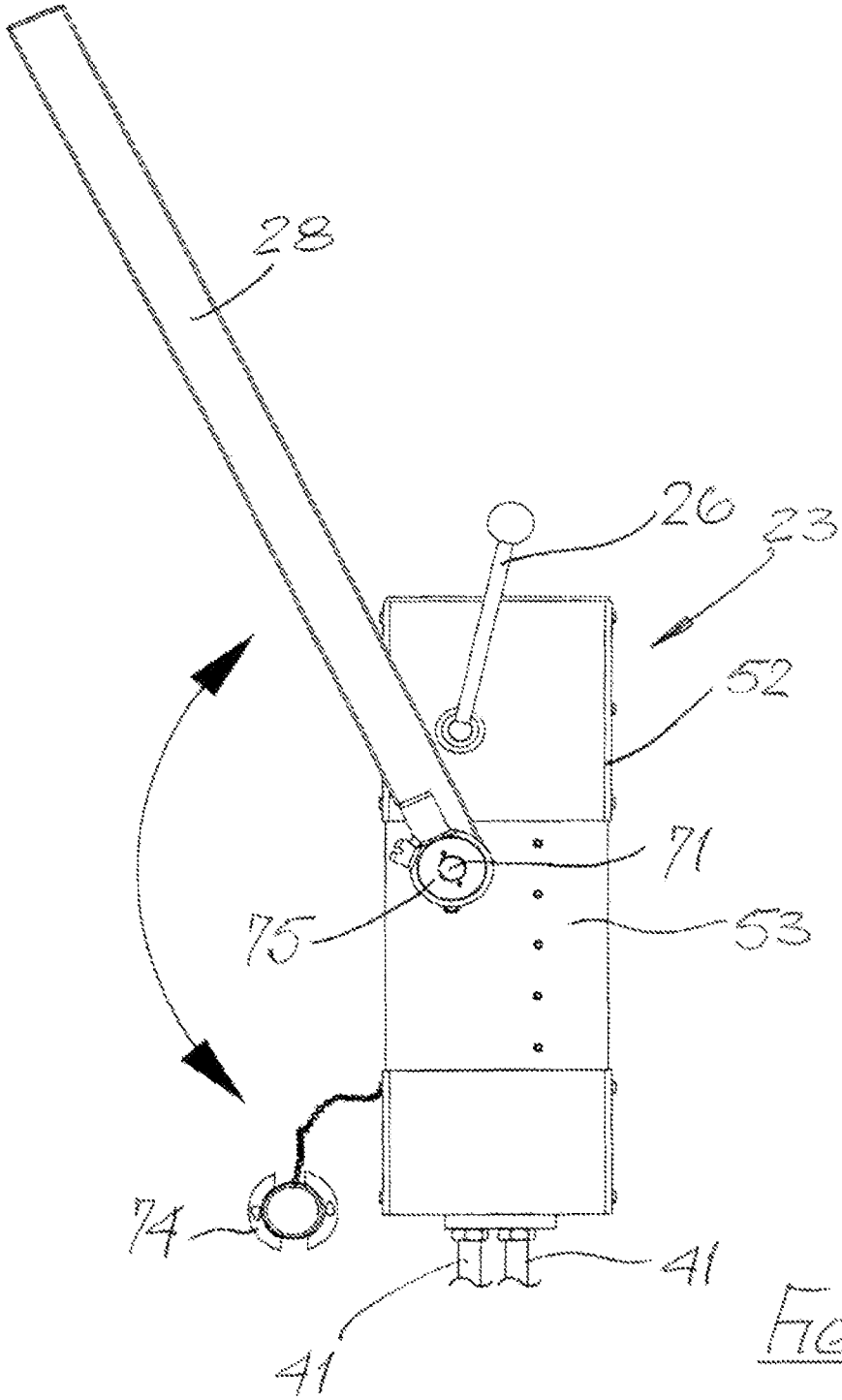
FIG. 9 is a side view of the control mechanism with an emergency release lever connected thereto.

FIGS. 6, 7 and 8 show the control mechanism for controlling the release of a lifting link 14 from the hook assemblies 22, acting through the flexible cables 24,25. The control mechanism comprises a housing 52 having a pair of side plates 53 on each of which is mounted a respective low friction guide 54 extending vertically. Slidably mounted between those guides is a mass 55, in this embodiment of about 22 kg, such that under the force of gravity that mass normally is in a lower position (FIG. 6), resting on a stop 56 mounted between side plates 53. Secured to the mass 55 is a linear toothed rack 57, the inner cables 43 of the two flexible cables 24,25 being secured to the lower end of that rack by means of a cross pin 58 extending through Heim joints provided on the free ends of those inner cables. The outer sheaths 41 of the two cables 24,25 are secured to a bottom plate 59 of the housing 52.

Extending transversely across and secured to the upper ends of the mass 55 and toothed rack 57 is a roller box 61 including opposed upper and lower walls 62,63 and opposed end walls 64,65. The primary release handle 26 is mounted on a release shaft 66 journalled in one side plate 53, there being a release arm 67 secured to that shaft within the housing. A roller 68 is rotatably mounted on the free end of the release arm 67 and is located in the roller box 61. It will thus be appreciated that counter-clockwise movement of the release handle 26 from its normal position shown in FIG. 6 to its hook-open position shown in FIG. 7 raises the mass 55 and toothed rack 57 by the action of the roller 68 running along the upper wall 62 of the roller box 61. The arm 67 together with the relative disposition of the release shaft 66 and end wall 64 is such that the arm 67 moves over-centre beyond vertical, as shown in FIG. 7, so that gravity acting on the mass 55 serves to maintain the mass and toothed rack in their raised position shown in FIG. 7.

Raising of the mass 55 and toothed rack 57 by the release handle 26 pulls the inner cables 43 relative to their outer sheaths, which thus moves the two hook members 34 from their closed settings (FIG. 4) to their open settings (FIG. 5). The hook members will be maintained in those settings until the release handle 26 is deliberately moved in a clockwise sense to take the arm 67 beyond vertical through the over-centre position once more, whereafter gravity acting on the mass 55 and toothed rack 57 returns the mechanism to the position shown in FIG. 6, so also returning the hook members 34 to their closed settings.

The emergency release mechanism comprises a gear carriage 70 mounted between the two side plates 53 and having a slot within which the rack 57 is slidably received. The carriage 70 rotatably supports an emergency release shaft 71 carrying a pinion 72 (FIG. 8) engaged with the rack 57, that shaft projecting beyond one side plate 53 of the housing 52. The projecting part of the shaft 71 has a square profile 73 and is enclosed within a removable shroud 74 (FIG. 9), which when removed is held captive by a chain. The shroud 74 serves to prevent access to the projecting part 73 of the shaft 71, until the shroud has been removed. When removed, the square profile 73 may be engaged by an emergency lever 28 incorporating a ratchet mechanism 75 such that when engaged, the lever may be reciprocated, so rotating the pinion 72 uni-directionally and raising the rack 57 and mass 55. In turn, this pulls the inner cables 43 of the flexible cables 24,25, to move the hook members to their open settings. In a typical embodiment, the emergency release lever 28 will require four or five reciprocations in order fully to raise the rack and mass from the position shown in FIG. 6 to that shown in FIG. 7 and so move the hook members 34 from their closed settings to their open settings.

In normal operation, the hook assemblies 22 are connected to a lifeboat (not shown) and the hook members thereof are coupled to lifting links 14 provided on the lower ends of suspension cables. As described above, the hook assemblies are of a load over centre design and so no rotational couple is imparted to the hook members by the load of the lifeboat. Nevertheless, in view of the weight of a connected lifeboat and carried personnel being of the order of 20 to 26 tonnes, a very significant force is required on the hook members in order to turn those hook members from their closed settings (FIG. 4) to their open settings (FIG. 5). That force cannot be imparted by the release handle 26 and so when the lifeboat is suspended in this way, the hook assemblies cannot inadvertently be released from the lifting links.

When the lifeboat is floating, there is very little loading on the hook assemblies and the primary release handle 26 may be operated to move the hook members 34 to their open settings and so free the lifeboat from the suspension cables. In an emergency situation, where the hook members are to be moved to their open settings when carrying a substantial load and the release handle 26 cannot be used, the emergency release lever 28 may be employed in conjunction with the emergency release mechanism to drive the rack 57 to its raised position. This forces the hook members 34 to their open settings notwithstanding the load thereon.

What is claimed is:

1. A suspension system for a lifeboat comprising:

a pair of hook assemblies adapted for connection at spaced locations to a lifeboat and for coupling respectively to a pair of suspension cables, each hook assembly having a hook member pivoted for movement about a pivotal axis between a closed setting where the line of action of a load on the hook member when in use passes substantially through the pivotal axis thereof and an open setting where an associated suspension cable is released from the hook member; and a control mechanism for the pair of hook assemblies which control mechanism comprises a housing, a mass mounted for movement within the housing, a pair of flexible release cables each having one end operatively connected to the mass and another end connected to a respective hook member to effect pivoting movement thereof, and a primary release mechanism for use when the hook assemblies are under no load, the primary release mechanism being coupled to the mass and having a release handle arranged so that when operated from a normal position to a hook-open position the mass is moved thereby pulling the flexible cables to pivot the hook members to their open settings.

2. The suspension system as claimed in claim 1, further comprising an emergency release mechanism also connected to the mass to effect movement thereof to move the hook members to their open settings, the emergency release mechanism being for use when the hook assemblies are under load and having a mechanical advantage relative to that of the primary release mechanism.

3. The suspension system as claimed in claim 1, wherein each hook assembly has a side plate provided with means for attachment directly or indirectly to a lifeboat, the hook member being pivotally mounted on the side plate and having a throat defined by an arcuate surface for engagement by a suspension cable, the arcuate surface being substantially centered on the pivotal axis of the hook member, wherein the hook member, pivotal axis and the attachment means are arranged such that the line of action of a load applied to the hook assembly by an attached lifeboat and a suspension cable retained by the hook member when in its closed setting passes substantially through the pivotal axis of the hook member, and pivotal movement of the hook member to its open setting releases the suspension cable from the hook assembly.

4. The suspension system as claimed in claim 3, wherein each hook assembly has a retainer pivotally mounted to the side plate for movement between first and second positions, the retainer when in its first position closing the throat of the hook member when in its closed setting to prevent a suspension cable coupled to the hook member coming free thereof, the retainer pivoting to its second position to allow a suspension cable to be engaged with the hook member when in its closed setting.

5. The suspension system as claimed in claim 4, wherein the retainer is furnished with a counterweight urging the retainer to its first position.

6. The suspension system as claimed in claim 5, wherein each hook assembly includes a pair of side plates with the hook member pivotally mounted therebetween.

7. The suspension system as claimed in claim 1, wherein each of the flexible release cables is arranged to transfer compressive as well as significant tensile forces from the mass to the respective hook member.

8. The suspension system as claimed in claim 7, wherein the mass is provided with biasing means arranged to urge the mass to a normal position where the hook members are in their closed settings.

9. The suspension system as claimed in claim 8, wherein the biasing means comprises a mass mounted within the housing for sliding movement under gravity to a lower position, such that gravity acting on the mass urges the hook members through the flexible cables to their closed positions.

10. The suspension system as claimed in claim 9, wherein the release handle of the primary release mechanism is pivoted to the control mechanism housing and is linked to the mass to effect lifting thereof against the force of gravity when the handle is pivoted from its normal position to its hook-open position when the hook members are under no load.

11. The suspension system as claimed in claim 10, wherein the primary release mechanism includes a release arm pivoted to the housing and engaged with a guide formed as a part of the mass extending transversely to the line of movement thereof, the release arm being coupled to the release handle for operation thereby.

12. The suspension system as claimed in claim 11, wherein the release handle and release arm are formed as a first order lever, the free end of the release arm being provided with a roller which runs on the guide.

13. The suspension system as claimed in claim 12, wherein the release arm and guide together form an over-centre mechanism arranged so that when the handle has been pivoted to its hook-open position, the release arm has moved over centre through vertical with respect to the guide so that gravity acting on the mass then retains the handle in the hook-open position.

14. The suspension system as claimed in claim 2, wherein the mass is provided with a toothed rack and the emergency release mechanism comprises a rotatable pinion engaged with the rack.

15. The suspension system as claimed in claim 14, wherein the pinion is mounted on a shaft projecting from the housing, an emergency operating lever being operatively engageable with the shaft when the emergency release mechanism is to be used.

16. The suspension system as claimed in claim 14, wherein the emergency release mechanism includes a ratchet associated with rotation of the pinion shaft such that the operating lever may be reciprocated to effect operation of the emergency release mechanism to effect release when the hook assemblies are under load.

17. The suspension system as claimed in claim 16, wherein the ratchet is incorporated in the operating lever adapted for engagement with the pinion shaft.

18. The suspension system as claimed in claim 1, wherein each suspension cable is provided with a respective lifting link at its free end, which link is engaged with the hook member of a hook assembly.

* * * * *